United States Patent [19]

Comer

[11] 4,312,120

[45] Jan. 26, 1982

[54] GLOW PLUG MANUFACTURE

[75] Inventor: Richard L. Comer, Findlay, Ohio

[73] Assignee: Bendix Autolite Corporation, Fostoria, Ohio

[21] Appl. No.: 152,242

[22] Filed: May 22, 1980

[51] Int. Cl.[3] ..... H01C 17/02

[52] U.S. Cl. ..... 29/611; 29/613; 29/520; 219/267; 219/270; 361/266

[58] Field of Search ..... 361/266, 264; 219/267, 219/270, 260; 123/145 A; 29/611, 613, 516, 520

[56] References Cited

U.S. PATENT DOCUMENTS

| | | | |
|---|---|---|---|
| 3,164,748 | 1/1965 | Testerini | 361/264 |
| 3,296,496 | 1/1967 | Baxter et al. | 361/266 |
| 3,749,980 | 7/1973 | Baxter | 219/267 |
| 3,934,116 | 1/1976 | Cunningham et al. | 29/611 |
| 4,087,904 | 5/1978 | Steinke et al. | 361/266 |
| 4,107,510 | 8/1978 | Tombs et al. | 123/145 A |
| 4,112,577 | 9/1978 | Mann | 361/266 |

FOREIGN PATENT DOCUMENTS

| | | | |
|---|---|---|---|
| 2247850 | 4/1974 | Fed. Rep. of Germany | 29/520 |

*Primary Examiner*—John McQuade
*Attorney, Agent, or Firm*—Raymond J. Eifler

[57] ABSTRACT

The invention is a method of making a pressure tight seal for a glow plug characterized by applying a high current to heat a groove (31) in the outer shell (3) of a glow plug while simultaneously pressing together the sealing elements adjacent the groove i.e. an insulator (2), a gasket (1), the flared end (42) of a protective tube (4) and a shoulder (32) within the shell (3). The grooves (31) concentrates the heat and allows the shell to be compressed around the elements of the seal.

5 Claims, 1 Drawing Figure

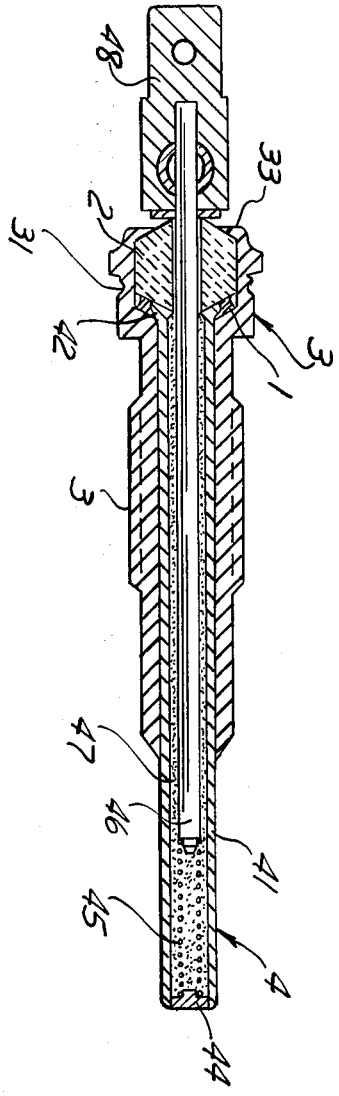
33
1
3
42
2
31
48
3
47
46
45
44
41
4

GLOW PLUG MANUFACTURE

The invention relates to a glow plug for an internal combustion engine using diesel fuel. The invention is more specifically related to a method of making a pressure tight seal within the glow plug.

BACKGROUND OF THE INVENTION

Glow plugs are used in internal combustion engines utilizing diesel fuel to facilitate starting. In cold weather, electrical energy supplied to a glow plug for each cylinder ignites the diesel fuel within each engine cylinder. Once the engine is in operation and becomes heated ignition of the diesel fuel occurs automatically and the electrical energy to the glow plug is discontinued. Examples of glow plugs may be found in U.S. Pat. Nos. 4,112,577; 4,087,904; and 3,749,980.

To prevent pressure within engine cylinders from being dissipated each glow plug is sealed internally so that pressure within an engine cylinder will not escape through the glow plug. Accordingly within each glow plug there is a pressure tight seal between the heater assembly its protective shield and the outer shell of the plug. This pressure tight seal has been provided by swaging or cold working the elements together and the use of a silver solder. The disadvantages of these types of seals are that they are expensive to make.

DISCLOSURE OF THE INVENTION

The invention is a method of making a pressure tight seal within a glow plug that eliminates the need for using silver solder and hence is less expensive.

The invention is a method of making a pressure tight seal for a glow plug characterized by applying a high current to heat a groove (31) in the outer shell (3) of a glow plug while simultaneously pressing together the sealing elements, adjacent the groove, i.e. a ceramic insulator (2), a gasket (1), the flared end (42) of a protective tube (4) and a shoulder (32) within the shell (3). The groove (31) concentrates the heat and allows the shell to be compressed around the elements of the seal.

Accordingly, this invention provides a pressure tight seal within a glow plug that does not require the use of silver solder.

DESCRIPTION OF THE INVENTION

FIG. 1 illustrates a cross-sectional view of a glow plug that includes a novel seal. The glow plug includes: an annular gasket 1; a tubular ceramic insulator 2; a tubular shell 3; and a heater assembly 4. The heater assembly 4 includes a central electrode or conductor 46, a heater element 45, insulating material 47, and a tube 41 having a flared end 42 and a closed end 44. The closed end 44 of the heater assembly includes the heater element 45. The heater element is a helical resistance type element which heats up when electrical current is passed through the element. The heater element and a central conductor 46 are electrically isolated from the protective tube 41 by a suitable insulating material 47 such as magnesium oxide (MgO). The shell 3 includes an annular groove 31; an internal shoulder, tapered to receive the gasket 1; and a crimped end portion 33.

The seal for the glow plug is assembled as follows: first, the annular insulator 2 is assembled onto the electrode 46 of the heater assembly 4. Electrical termination element 48 is then mounted to the electrode 46. Next the annular gasket is placed in the shell and the tube 41 of the heater assembly 4 is placed through the gasket 1 and through the shell 3 so that the heater element portion 45 of the heater assembly 4 extends through the shell 3. Next, the other end portion 33 of the shell 3, which was open, is bent inwardly (crimped) to captivate the insulator 2, the gasket 1 and the flared end 42 of the tube 41. Further, the end portion 33 will prevent the heater assembly from being expelled from the shells should the seal fail under extreme internal pressure during operation in an engine. Then, pressure is applied to the end of the shell 33 to provide pressure contact between the insulator 2, the flared end 42 of the tube 41, the gasket 1 and the internal shoulder of the shell 3. A current is then passed through the upper portion of the shell until the groove 31 glows red hot. Infrared detectors monitor the temperature and when it reaches 1600° F. to 1700° F. the current is discontinued and the shell is allowed to cool and contract, increasing the pressure between the elements of the seal. Originally, the groove 31 was not bulged out as is shown. The bulging occurs because of the pressure applied to the shell while the temperature of the metal shell is raised to its softening point with the pressure causing the groove to then bulge outwardly. In actual practice, a voltage of 2 volts and a current of 6600 amps for about two seconds was used to raise the temperature of the shell around the groove to the softening point so that the material could be compressed. The purpose of the groove 31 is to reduce the cross-sectional area of the shell 3 at a point adjacent the gasket 1 so that when the current is passed through the shell the smaller cross-sectional area of the shell carrying the same amount of current as the wider cross-section of the shell will have a higher temperature and hence soften before the other portions of the shell. This enables the groove portion of the shell to be compressed when a pressure is applied to the end portion 33 of the shell 3.

While a preferred embodiment of the invention has been disclosed, it may be apparent to others skilled in the art that changes may be made to the invention as set forth in the appended claims, and, in some instances, certain features of te invention may be used to advantage without corresponding use of other features. For example, inductive type heating could also be used to heat the outer shell to the desired softening temperature to make an effective seal. Accordingly, it is intended that the illustrative and descriptive materials herein be used to illustrate the principles of the invention and not to limit the scope thereof.

I claim:

1. A method of forming a gas tight seal for a glow plug of the type having an annular gasket, a tubular insulator, a tubular metal shell, and a heater assembly including an outer metal tube having a closed end and an opposite open end, the method comprising:

flaring one end of the metal tube;

forming an annular groove on the outside of said shell;

forming an annular shoulder inside said shell adjacent said groove;

placing the annular gasket inside said shell with one side of said gasket against the shoulder in said shell;

placing a portion of said heater assembly into said shell with the closed end of said tube extending from one end of said shell;

locating one side of the flared end of said tube against the opposite side of said gasket;

placing said insulator into said shell with one end of said insulator against the opposite side of the flared end of said tube;

forming the other end of said shell against the other end of said insulator to captivate said insulator, gasket, and flared end of said tube inside said shell; and applying pressure to said other end of said shell to press said insulator, gasket, flared end of said tube and said shoulder against each other while simultaneously passing an electrical current through said shell to heat said shell until the metal around the groove softens, whereby when said electrical current is removed and said shell cools, said shell contracts to form a pressure tight seal between said insulator, tube, gasket and shell.

2. The method recited in claim 1 wherein the electrical current passed through said metal shell is about 6600 amperes for about 2 seconds.

3. The method as recited in claim 1 wherein electrical current is passed through said metal shell until the temperature of the metal around said groove is in the range of 1600 degrees farenheit to 1700 degrees farenheit.

4. A method of forming a gas tight seal for a glow plug of the type having an annular gasket, a tubular insulator, a tubular metal shell having a shoulder inside said shell and an annular groove in the outside of said shell adjacent said shoulder, and a heater assembly including a protective metal tube having a closed end and an opposite open flared end, the method comprising:

placing the annular gasket inside said shell with one side of said gasket against the shoulder in said shell;

placing a portion of said heater assembly into said shell with the closed end of said tube extending from one end of said shell;

locating one side of the flared end of said tube against the opposite side of said gasket;

placing said insulator into said shell with one end of said insulator against the opposite side of the flared end of said tube;

forming the other end of said shell against the other end of said insulator to captivate said insulator, gasket, and flared end of said tube inside said shell; and applying pressure to said other end of said shell to press said insulator, gasket, flared end of said tube and said shoulder against each other while simultaneously passing an electrical current through said shell to heat said shell until the metal around the groove softens, whereby when said electrical current is removed and said shell cools, said shell contracts to form a pressure tight seal between said insulator, tube, gasket and shell.

5. The method as recited in claim 1 wherein electrical current is passed through the portion of said metal shell with said groove until the temperature of the metal around the groove is in the range of 1600 degrees farenheit to 1700 degrees farenheit.

* * * * *